US006418771B1

(12) United States Patent
Raffin et al.

(10) Patent No.: US 6,418,771 B1
(45) Date of Patent: Jul. 16, 2002

(54) INTERIOR HEMMING MACHINE

(75) Inventors: Louis Raffin; Raymond Cote; Lee Harrison, all of Windsor (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/694,529

(22) Filed: Oct. 23, 2000

(51) Int. Cl.[7] ..... B21D 39/02
(52) U.S. Cl. ..... 72/393; 29/243.58
(58) Field of Search ..... 72/393; 29/243.517, 29/243.518, 243.58

(56) References Cited

U.S. PATENT DOCUMENTS 2,362,350 A * 11/1944 Buck ..... 29/243.518
5,979,208 A * 11/1999 Hartley ..... 29/243.58
6,182,492 B1 * 2/2001 Raffin et al. ..... 29/243.58
6,223,581 B1 * 5/2001 Zimmer ..... 72/393

* cited by examiner

*Primary Examiner*—Lowell A. Larson
(74) *Attorney, Agent, or Firm*—Gifford, Krass, Groh, Sprinkle, Anderson & Citkowski, P.C.

(57) ABSTRACT

An inside perimeter hemming machine is disclosed having a base adapted to be supported by a ground surface. A nest adapted to support the part to be hemmed is vertically movably mounted relative to the base between predetermined vertical positions while at least one actuator vertically moves the nest relative to the base. A die assembly housing is mounted to the base, and this die assembly housing extends through the-opening on the part to be hemmed. At least two die sets are horizontally slidably mounted to the housing so that the die sets are movable between an extended and a retracted position. In their extended position, the die sets overlay the part to be hemmed so that, upon vertical displacement of the nest, a prehem or hem is performed. Conversely, when the die sets are in their retracted position, the nest together with the part to be hemmed is freely vertically movable. A wedge drive member is utilized to simultaneously move the die sets between their extended and retracted positions.

8 Claims, 10 Drawing Sheets

INTERIOR HEMMING MACHINE

BACKGROUND OF THE INVENTION

I. Field of the Invention

The present invention relates generally to hemming machines and, more particularly, to an inside perimeter hemming machine.

II. Description of the Prior Art

There are many previously known inside perimeter hemming machines of the type used to form an interior hem on a manufactured part, such as an automotive door panel. These previously known interior hemming machines typically comprise a base and a nest which is vertically movably mounted relative to the base. The nest supports the workpiece or part to be hemmed and is vertically movable by actuators to predetermined vertical positions relative to the base.

In order to form the hem, typically two die sets are pivotally mounted to the base and movable between an operative position and an inoperative position. In their operative position, the die sets overlie the workpiece so that, upon vertical movement of the nest, the workpiece carried by the nest impacts upon the die sets to form the prehem and then final hem. Conversely, in their inoperative position, the die sets are pivoted away from the nest so that the nest can be vertically displaced without interference from the die sets.

Typically, a first die set forms a prehem, i.e. the metal forming the hem is bent at approximately a 45° angle. After the prehem is formed, the prehem die set is moved to its inoperative position and the other or final hem die set is moved to its operative position also overlying the workpiece on the nest. The nest is then vertically displaced against the second die set which forms the final hem on the workpiece.

In forming an interior hem around a workpiece such as a door panel, the interior hem is formed around three sides of the workpiece. In order to produce an acceptable hem, the previously known interior hemming machines have utilized both a prehem and final hem die set which, when in their operative position, extend continuously around the three sides of the workpiece to be hemmed. This has necessarily entailed overly complex and therefore expensive constructions for both the prehem and final hem die set. Furthermore, the mechanism utilized to pivotally move the prehem and final hem die sets to the base imposes a nonlinear relative motion between the nest and dies, and present and angular deflection when applying the final hemming force, which will affect the geometrical quality of the hem.

SUMMARY OF THE PRESENT INVENTION

The present invention provides an inside perimeter hemming machine which overcomes all of the above-mentioned disadvantages of the previously known devices.

In brief, the interior hemming machine of the present invention comprises a base which is adapted to be supported by a ground surface. A nest is vertically movably mounted to the base and this nest is adapted to support the workpiece, such as a door panel, to receive the interior hem. An appropriate actuator, such as a hydraulic or electric actuator, is then utilized to vertically displace the nest together with its supported workpiece between predetermined vertical positions relative to the base.

A die assembly housing is also mounted to the base such that the die assembly housing is positioned within the opening of the workpiece around which the interior hem is to be performed. For example, in the case of an automotive door panel, the die assembly housing would be positioned through the window opening. Furthermore, in this case, the hem would be performed around both sides and the top of the window opening.

At least two die sets and preferably three die sets are horizontally slidably mounted to the housing so that the die sets are movable between an extended and a retracted position. Each die set, furthermore, is vertically spaced from the other two die sets. One die set is utilized to perform the prehem, the second die set performs the final hem along most of the length of each of the three hemmed sides of the workpiece, while the third die set forms a final hem on the corners of the workpiece. A fourth die set can be easily added to perform the corner hem in two stages rather than one.

In order to horizontally move the die sets between their extended and retracted positions, at least one wedge drive member is associated with each side of the die set and these drive members each include a drive surface which lies on a plane skewed with respect to the direction of movement of the nest. Consequently, for a three sided interior hem of the type typically formed on an automotive door panel, the prehem and final hem die sets each have three drive members although the drive members in each set may be of a one-piece construction. At least one driven member is then associated with each drive member wherein each driven member includes a skewed surface which flatly abuts against the skewed surface of its associated drive member.

The die assembly housing constrains the driven members against vertical movement. Consequently, vertical displacement of the drive members horizontally moves the driven members together with their attached die sets between the extended and the retracted positions. In order to vertically displace the drive members, preferably a conventional pneumatic or hydraulic cylinder can be used to move the shaft up and down. Consequently, as the shaft is vertically moved by the cylinder, the drive members are horizontally displaced either in or out depending upon the direction of movement of the shaft.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

Detailed Description of a Preferred Embodiment of the Present Invention

Figure 1:
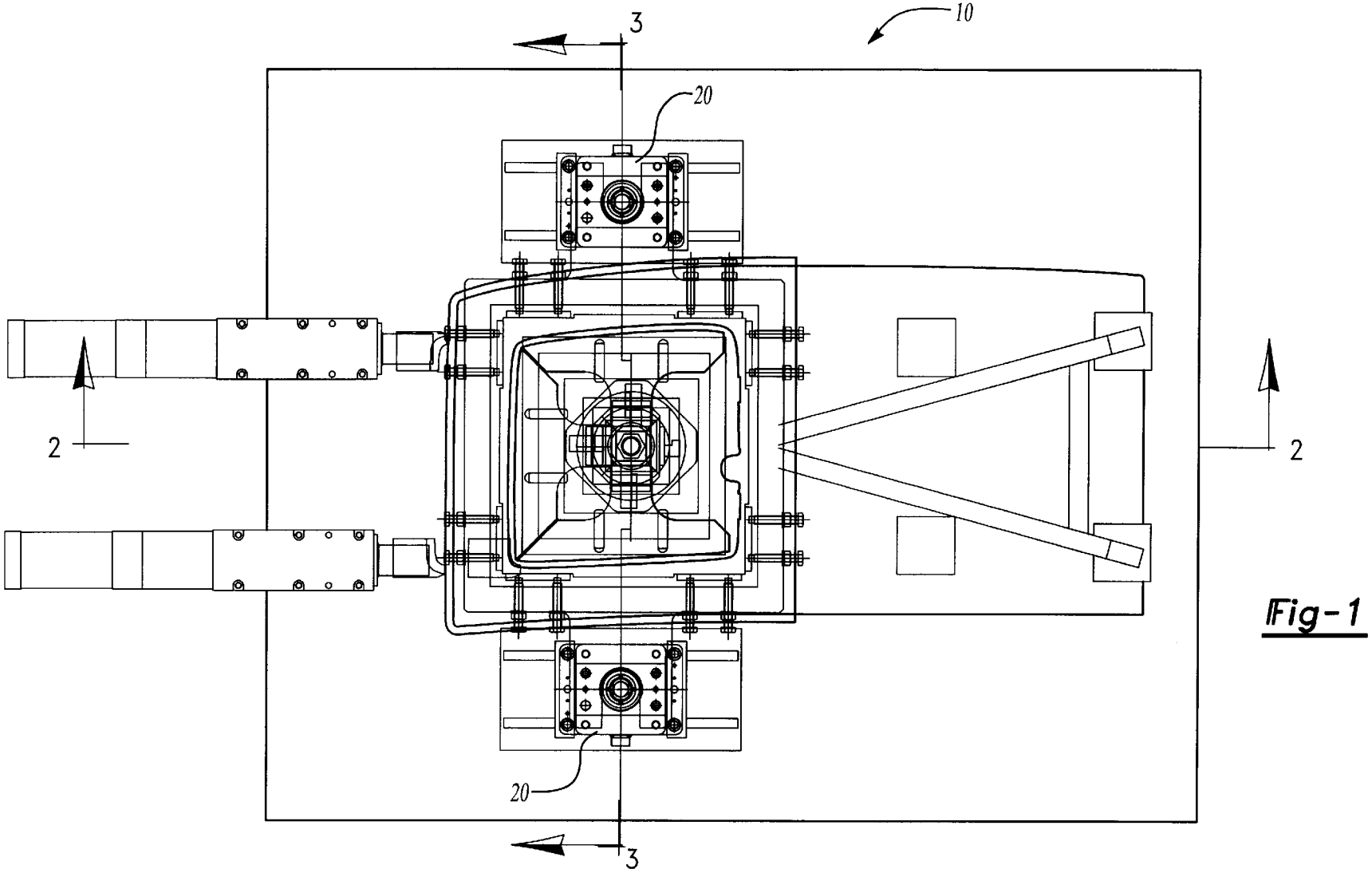
FIG. 1 is a top view illustrating a preferred embodiment of the present invention.
Figure 2:
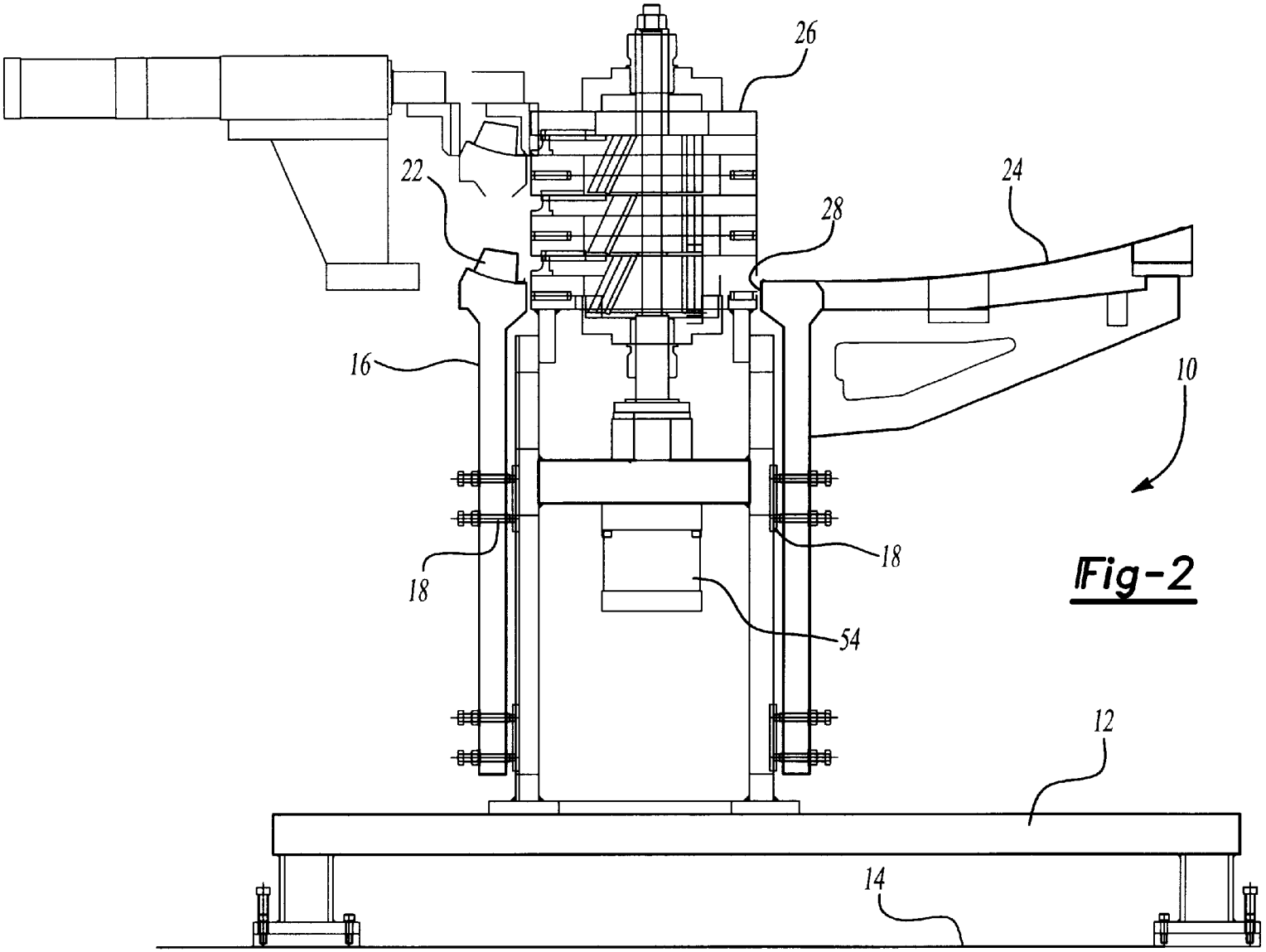
FIG. 2 is a view taken substantially along line 2—2 in FIG. 1.
Figure 3:
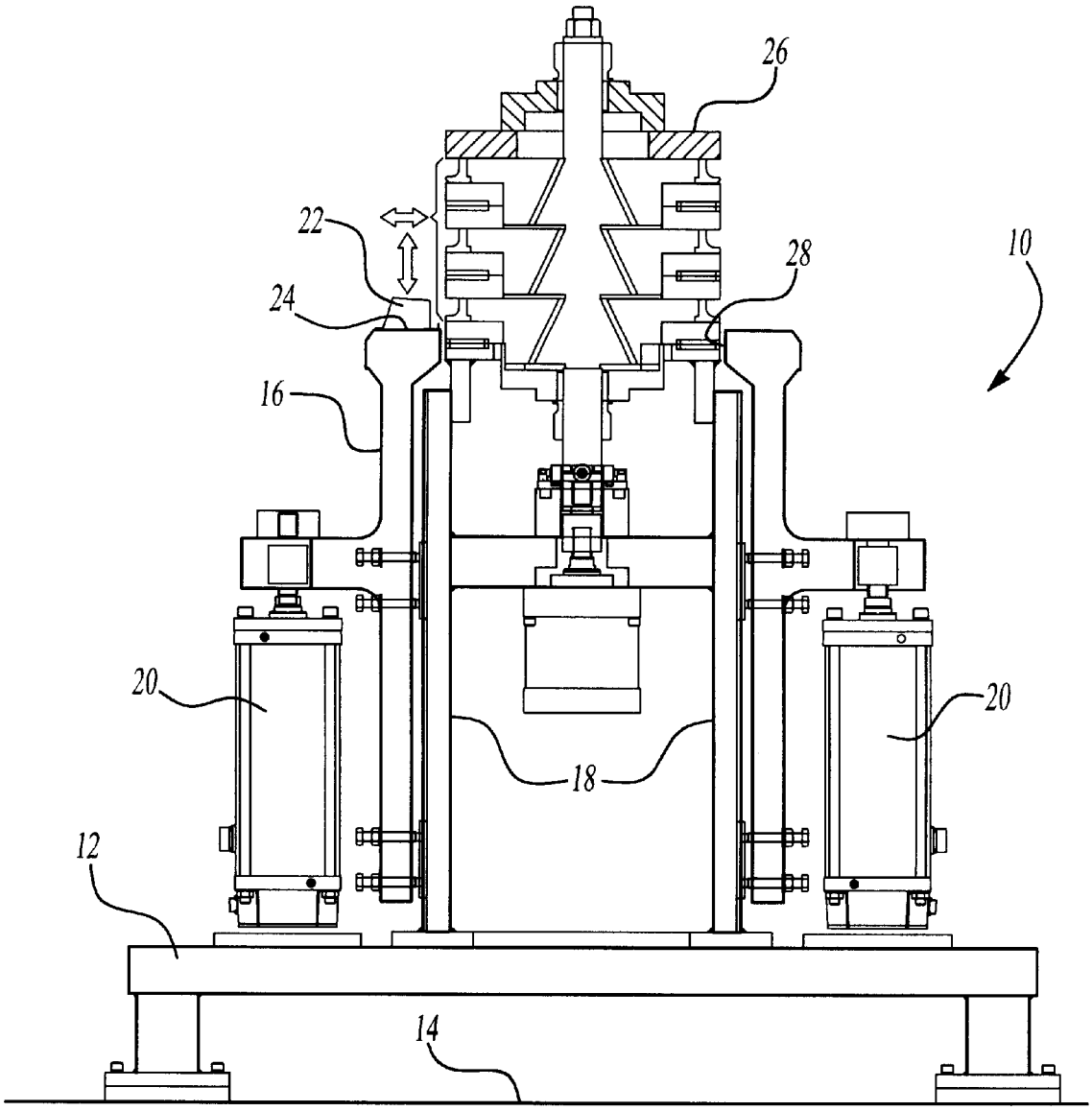
FIG. 3 is a view taken substantially along line 3—3 in FIG. 1.

With reference first to FIGS. 1–3, a preferred embodiment of the inside perimeter hemming machine 10 of the present invention is there shown having a base 12 adapted to be supported on a ground surface 14. As best shown in FIGS. 2 and 3, a nest 16 is vertically slidably mounted to the base 12 by ways 18. Any conventional means, such as hydraulic actuators or electronically synchronized electro-servo cylinder 20 (FIGS. 1 and 3), are used to vertically move the nest 16 between preselected vertical positions relative to the base 14.

The nest 16 in the conventional fashion supports the part 22 which is to receive the inside hem on the upper surface 24 of the nest 16. The workpiece 22 can comprise, for example, a door panel in which the inside hem is formed around three sides of the window opening, i.e. the top and two sides of the window.

Figure 4:
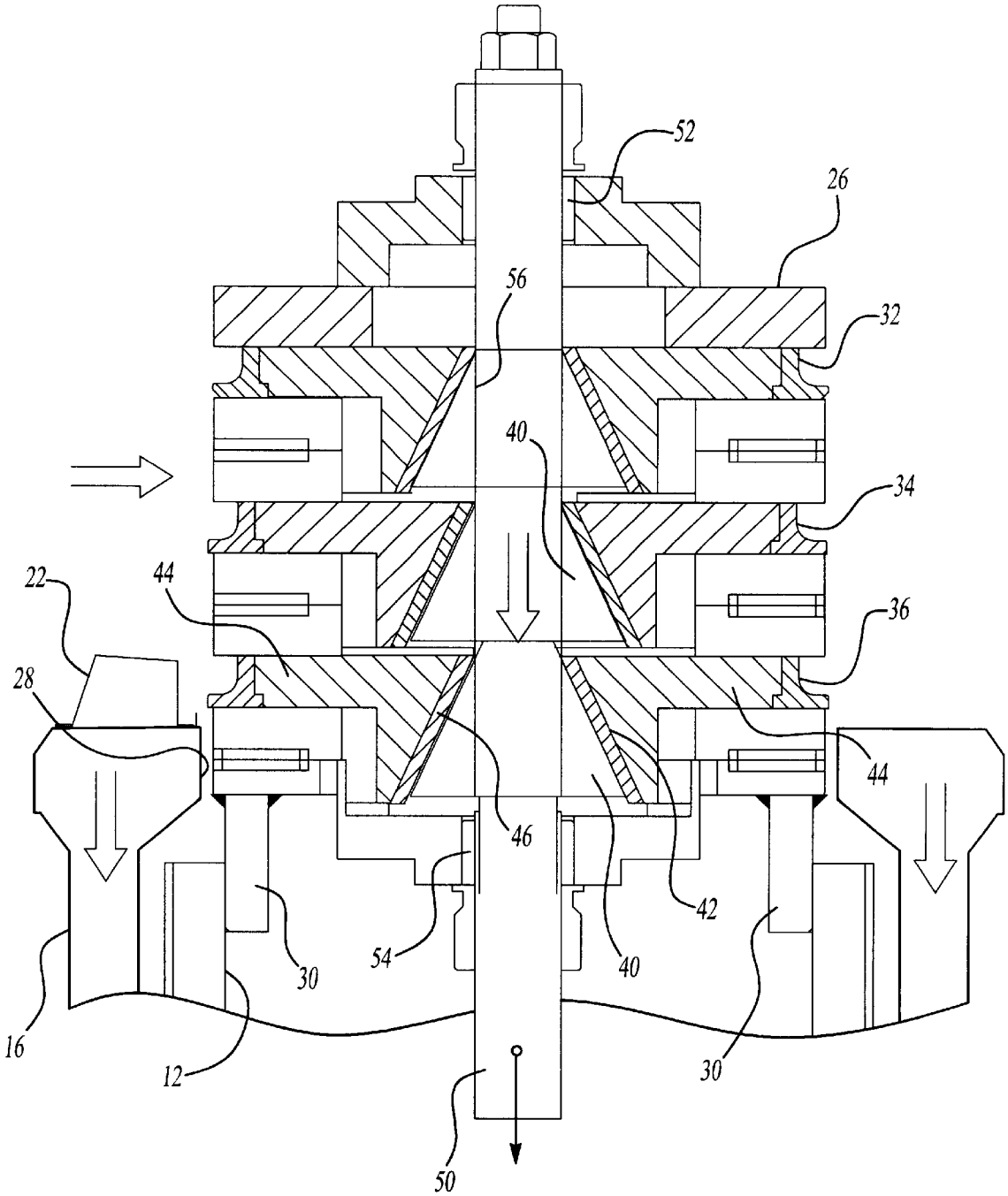
FIG. 4 is a diagrammatic partial sectional view illustrating a portion of the preferred embodiment of the present invention and with the die sets in their retracted position.

With reference now particularly to FIGS. 2–4, a die assembly housing 26 is mounted to the base 12 such that the housing 26 is positioned through an opening 28 in the nest 16 and thus through the opening in the workpiece 22 around which the inside perimeter hem is to be formed. As best shown in FIG. 4, the housing 26 is fixed against vertical movement to the base 12 in any conventional fashion, such as by supports 30.

With reference now particularly to FIG. 4, at least two and preferably three die sets 32, 34 and 36 are contained within the housing 26. These die sets 32–36 are vertically spaced from each other and are adapted to perform different portions of the hem. For example, the die set 32 performs the prehem along a major extent of the sides of the part to be hemmed while the die set 34 performs the final hem along the major extent of the sides of the part to be hemmed. In a fashion that will subsequently be described in greater detail, the third die set 36 performs a final corner hem for the workpiece 22.

Figure 5:
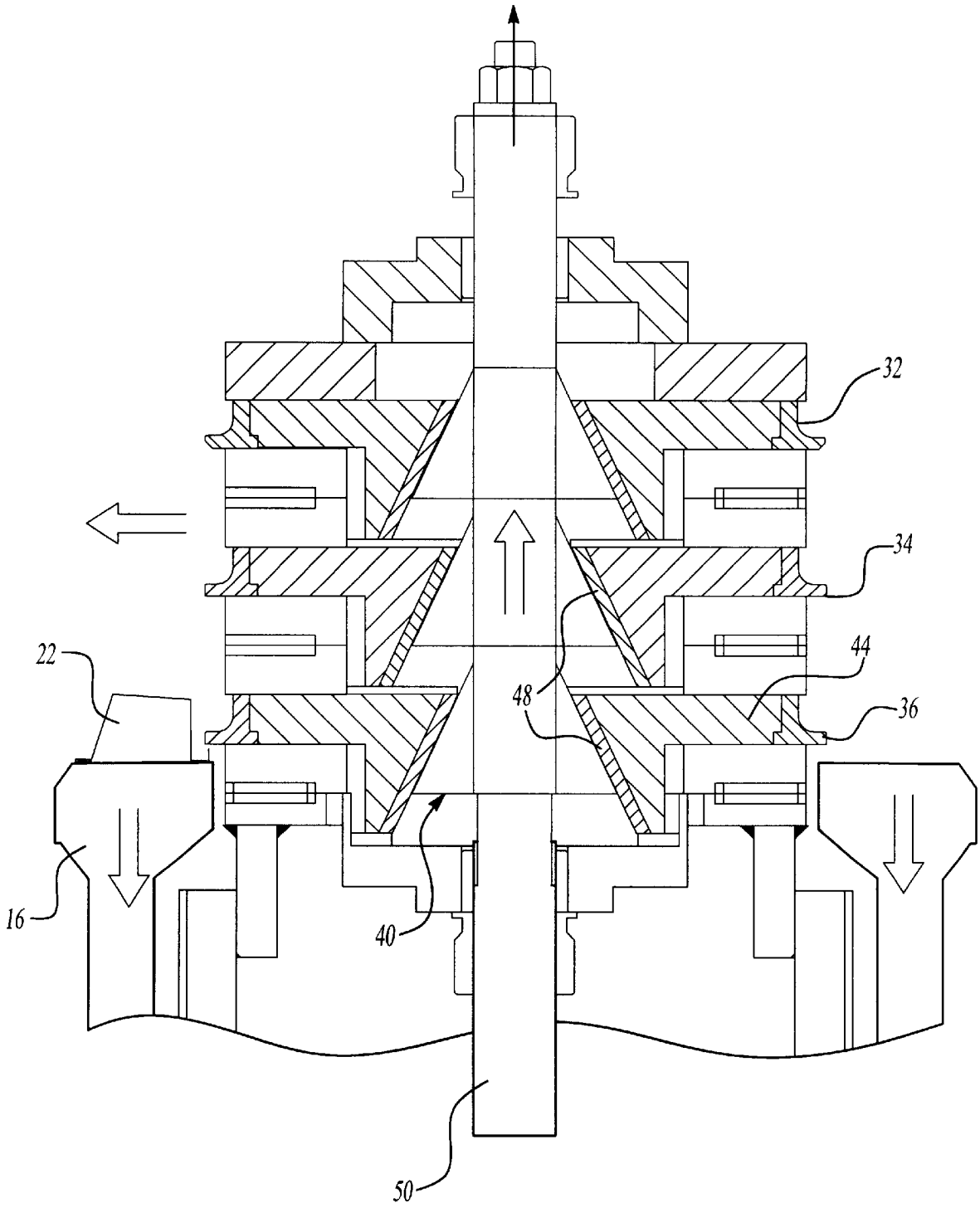
FIG. 5 is a view similar to FIG. 4 but illustrating the die sets in their extended position.

With reference now to FIGS. 4 and 5, the die sets 32–36 are fixed against vertical movement relative to the housing 26 but are horizontally movable between a retracted position, illustrated in FIG. 4, and an extended position, illustrated in FIG. 5. In their extended position (FIG. 5), the die sets 32–36 overlie an inner periphery of the nest 16 and thus the part to be hemmed. Consequently, with the die sets 32 in their extended position, vertical displacement of the nest 16 causes the part 22 to be squeezed against the registering die set 32, 34 or 36 thus forming either the prehem, final hem or corner hem. Conversely, with the die sets 32–36 in their retracted position, the die sets 32–36 are spaced inwardly from the nest opening 28 so that the nest 16 can be freely vertically displaced without interference from the die sets 32–36.

Still referring to FIGS. 4 and 5, in order to horizontally move the die sets 32–36 between their retracted and extended positions, at least one drive member 40 is associated with each side of each die set 32–36. Consequently, assuming the die sets 32 and 34 perform a three sided hem around a window opening in a door panel, each die set 32 and 34 includes three drive members 40 with one die attached to each drive member 40. The drive members 40, furthermore, are vertically movably mounted in the housing 26.

The drive member 40 includes an outer surface 42 which is skewed relative to the direction of movement of the nest 16. A driven member 44 is associated with each drive member 40 and this driven member 44 also includes a skewed surface 46 which abuts against the skewed surface 42 on the drive member 40. Consequently, vertical displacement of the drive members 40 from the position shown in FIG. 4 and to the position shown in FIG. 5 horizontally displaces the driven members 44 together with their attached die sets 32–36 due to the interaction between the skewed surfaces 42 and 46.

In order to ensure that the driven members 44 move between their extended and retracted position in unison with the vertical displacement of the drive members 40, preferably at least one dovetail connection 48 is provided on the abutting surfaces of the drive member 40 and driven member 44. This dovetail connection not only ensures that the driven members 44 are driven radially outwardly as the drive members 40 are moved to their upper position (FIG. 5) but also ensures that the driven members 44 together with their die sets 32–36 are retracted to their inner position (FIG. 4) once the driven members 44 are vertically displaced to their lower position.

Any up to date means like a servo-motor driving a ball screw can be employed to vertically displace the drive members 40, and thus horizontally displace the die sets 32–36. However, in the preferred embodiment of the invention, a simple pneumatic cylinder 54 is axially connected to the shaft 50 through a coupling device. Consequently, sliding of the shaft 50 in the way up moves the drive members 40 from the position shown in FIG. 4 to the position shown in FIG. 5. Conversely, sliding of the shaft 50 in the way down moves the drive members 40 from the position shown in FIG. 5 and to the position shown in FIG. 4. Any conventional linear actuator 54 (FIG. 2) can be utilized to vertically displace the drive members 40.

Unlike the previously known internal hemming machines, the sliding of the shaft 50 simultaneously displaces all of the die sets 32–36 relative to the die set housing 26.

Although the shaft 50 is preferably utilized to vertically displace the drive members 40, alternatively a hydraulic or electric actuator may be employed to move the drive members 40 between their upper position (FIG. 5) and lower position (FIG. 4) in unison with each other. Still other means may alternatively be used.

Figure 6B:
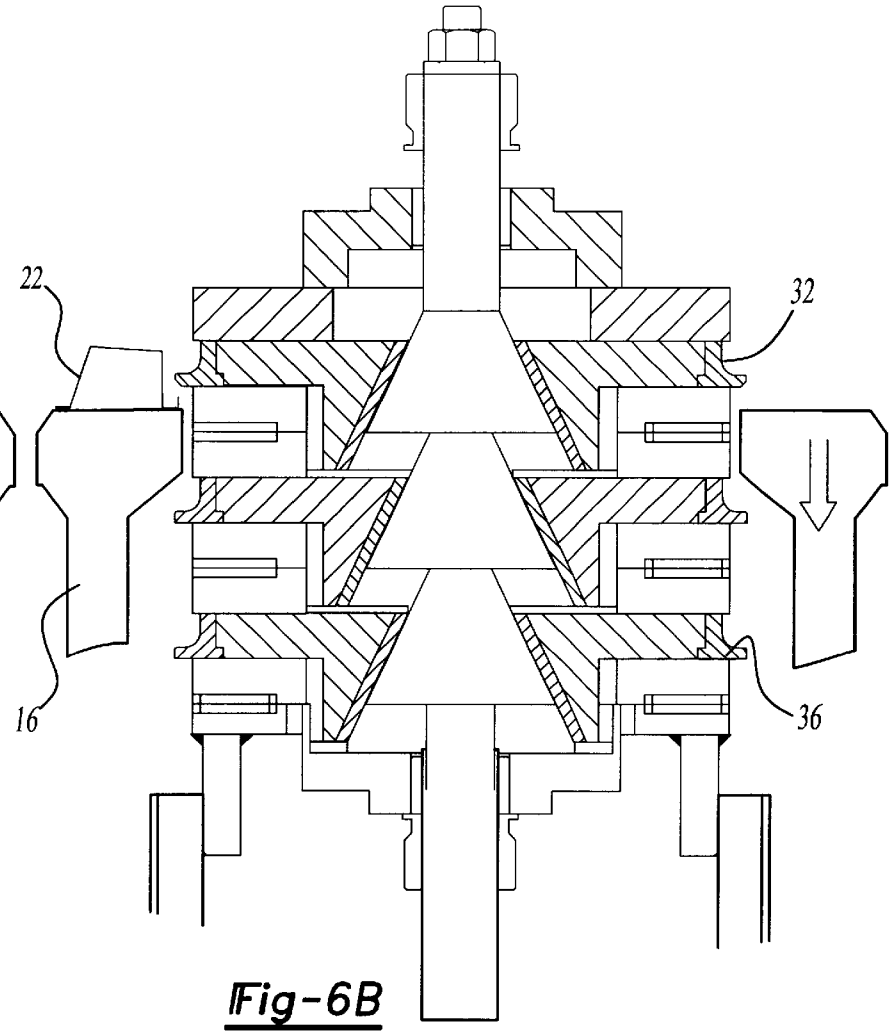
FIGS. 6A–6J are all diagrammatic views illustrating the operation of the preferred embodiment of the present invention.
Figure 6A:
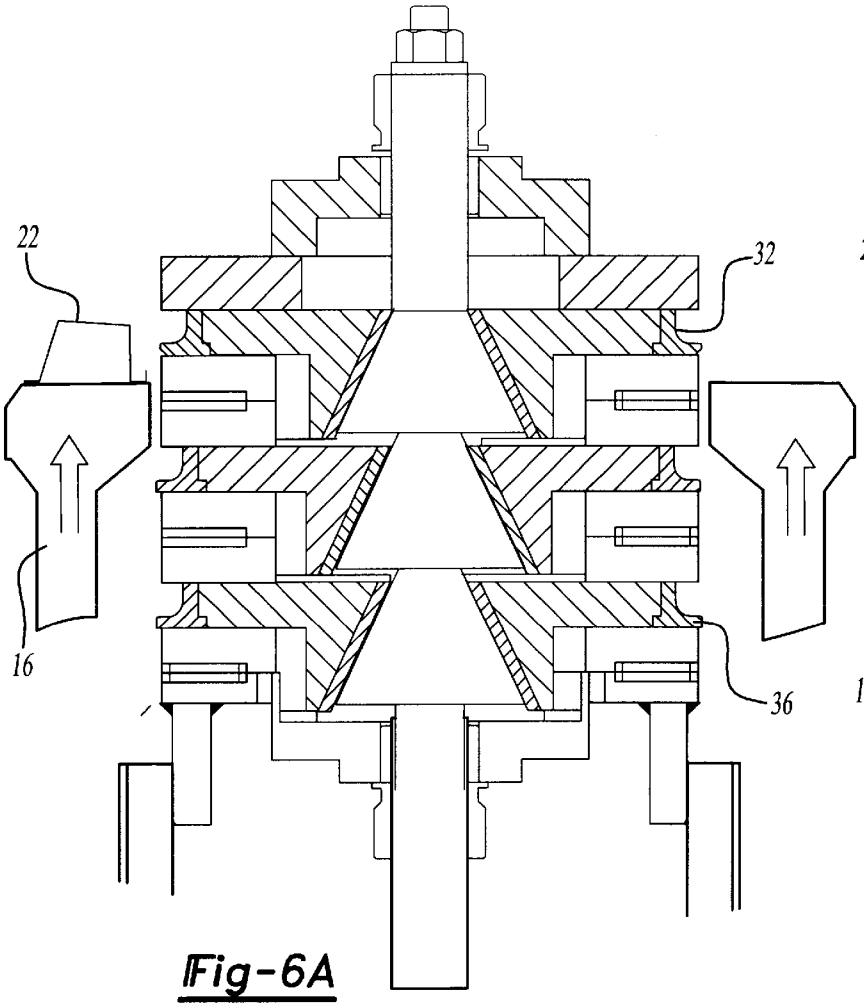

With reference now to FIGS. 6A–6J, the operation of the hemming machine will now be described. With the unhemmed workpiece 22 positioned on the nest 16 and with the die sets 32–36 in their retracted position, the nest 16 is first moved to the position shown in FIG. 6A in which the workpiece 22 is positioned beneath the die set 32. The die sets 32–36 are then moved to their extended position as shown in FIG. 6B by actuation of the pneumatic cylinder 54 (FIG. 2).

Figure 6D:
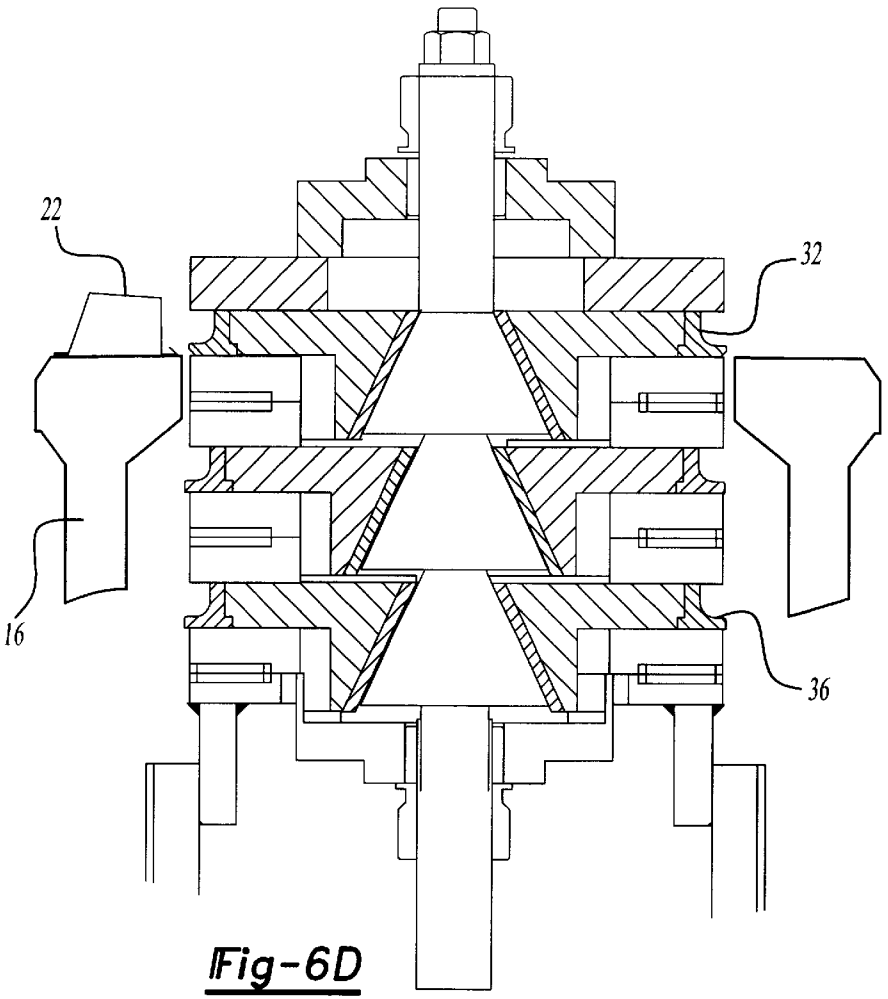
Figure 6C:
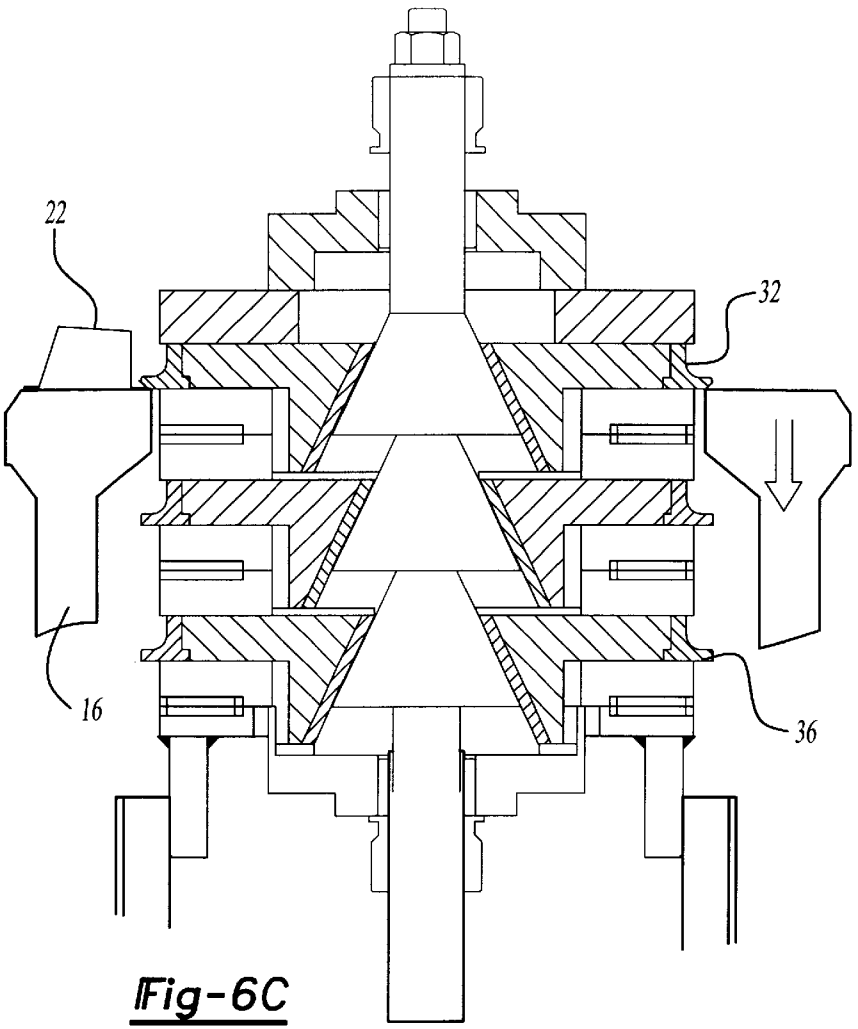
Figure 6F:
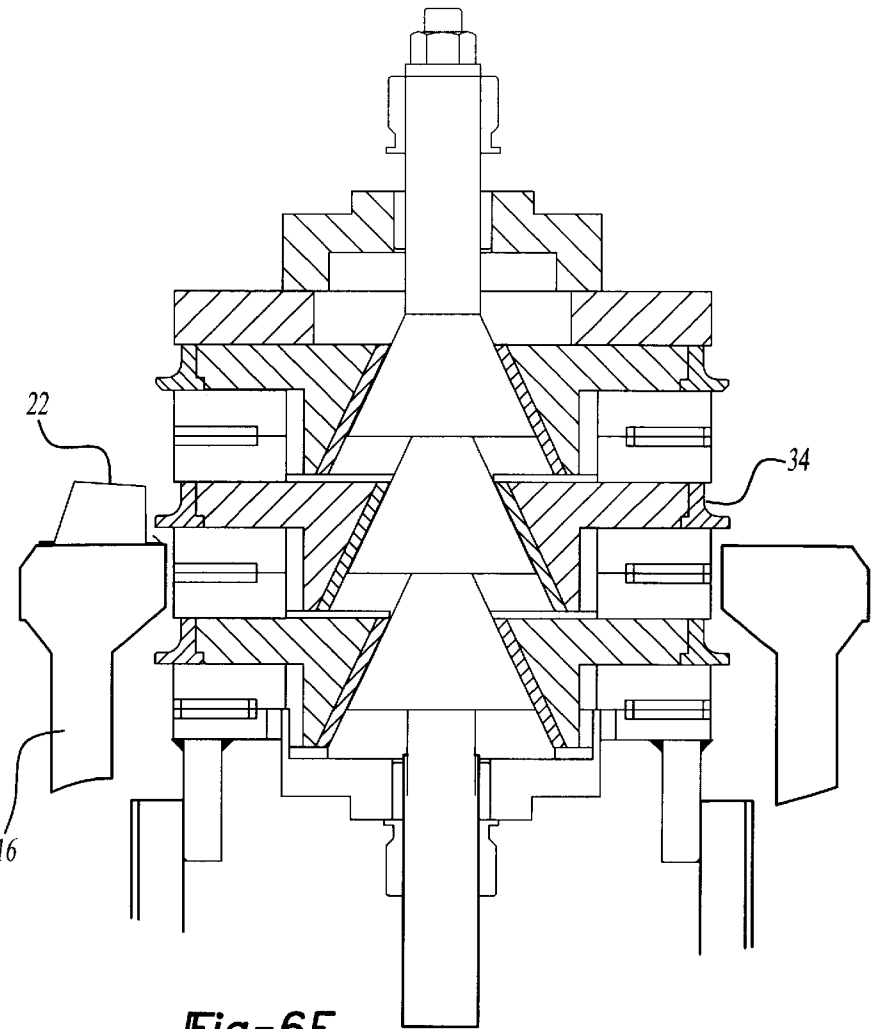
Figure 6E:
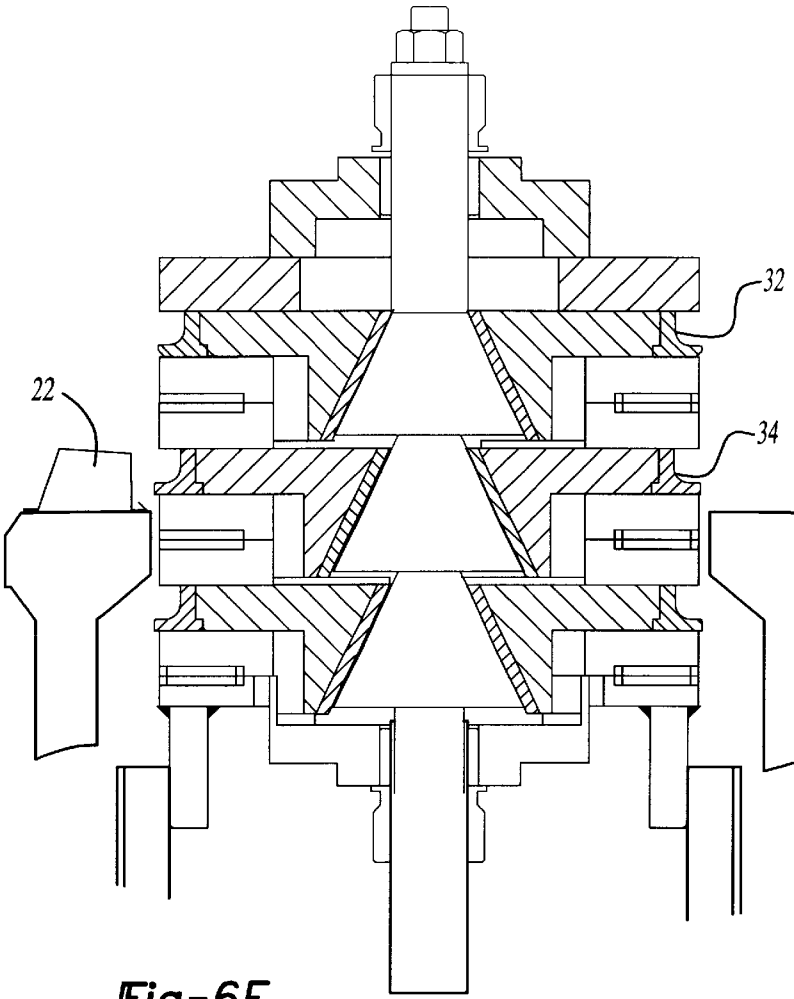

With the die sets 32–36 still in their extended position, the nest 16 is then displaced vertically upwardly so that the workpiece 22 is squeezed against the first die set 32 as shown in FIG. 6C thus forming the prehem. The die sets 32–34 are then moved to their retracted position as shown in FIG. 6D and the nest 16 is moved to a position just beneath the second die set 32 as shown in FIG. 6E. The die sets 32 are then moved to their extended position as shown in FIG. 6F in which the die sets overlie the part 22 to be hemmed. The nest 16 is then again displaced vertically upwardly to the position shown in FIG. 6G in which the part 22 is squeezed against the second die set 34 thus forming the final hem along the major extent of the hem formed on the workpiece 22. However, since the die sets 32 and 34 extend around three adjacent sides, it is not possible for the die sets 32 and 34 to be completely continuous at the corners of the workpiece. Consequently, the third die set 36 performs a final hem on the corners of the workpiece 22.

Figure 6H:
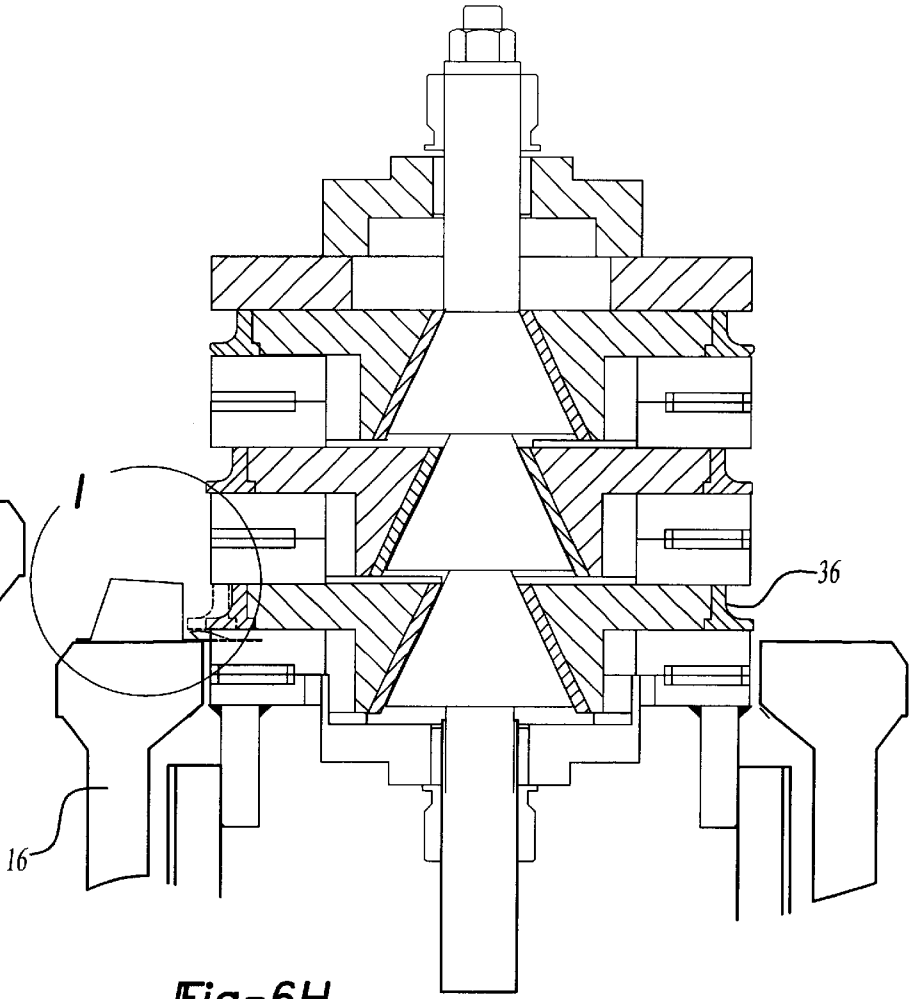
Figure 6G:
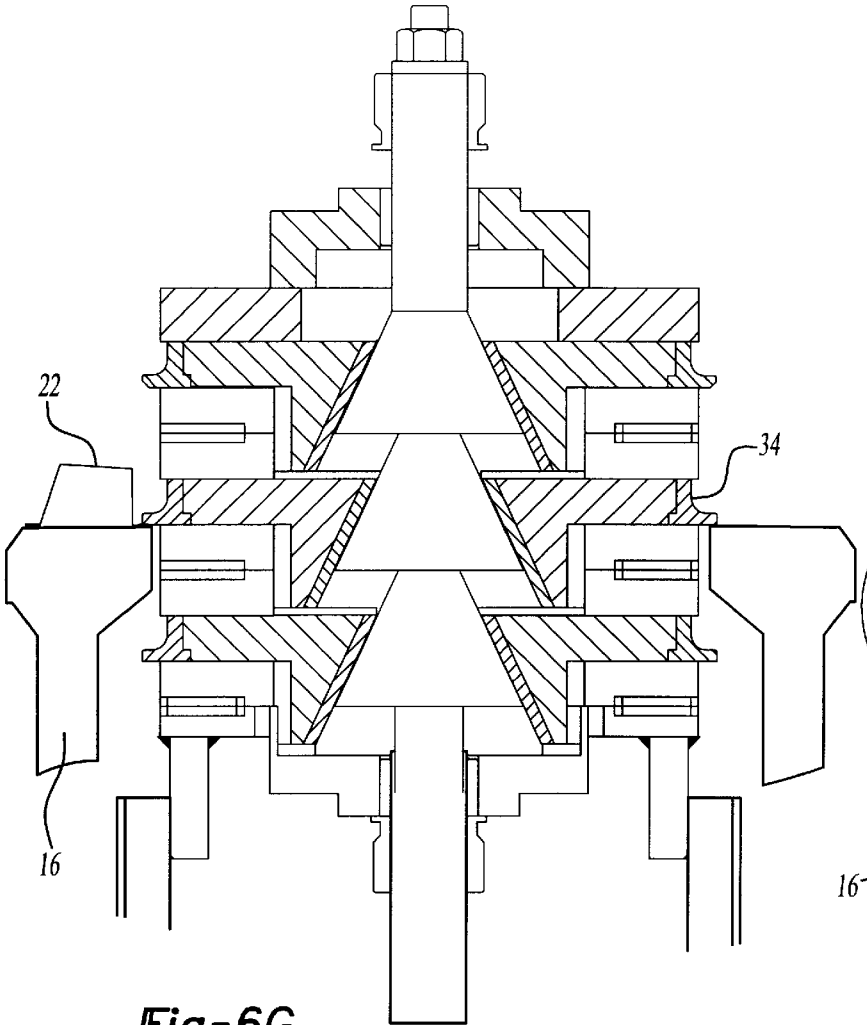
Figure 6I:
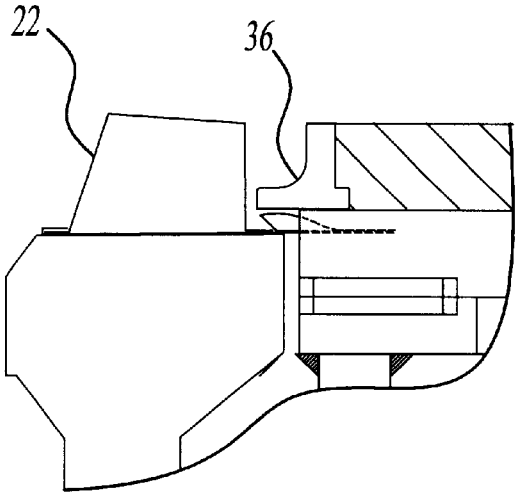
Figure 6J:
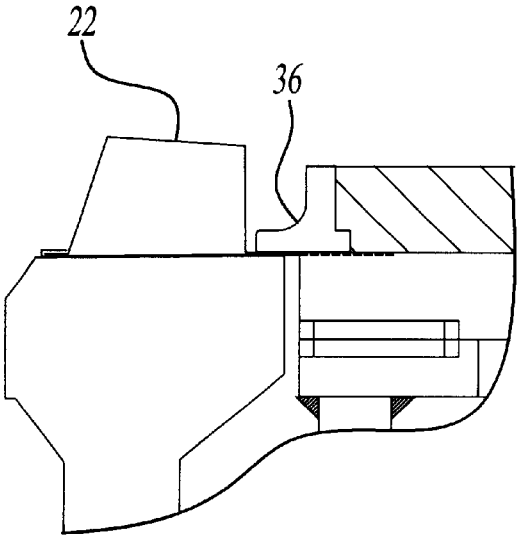

In order to perform the corner hem, the die sets 32–34 are again retracted and the nest 16 is moved to the position shown in FIG. 6H in which the nest with the workpiece 22 is positioned just below the corner hem die set 36. The die set 36 is then moved to its extended position as shown in FIG. 6I so that upper vertical displacement of the nest 16 to the position shown in FIG. 6J squeezes the workpiece 22 against the corner die set 36 thus completing the hem. The die sets 32–36 are then moved to their retracted position and the finished workpiece 22 is ejected from the hemming machine.

Figure 7:
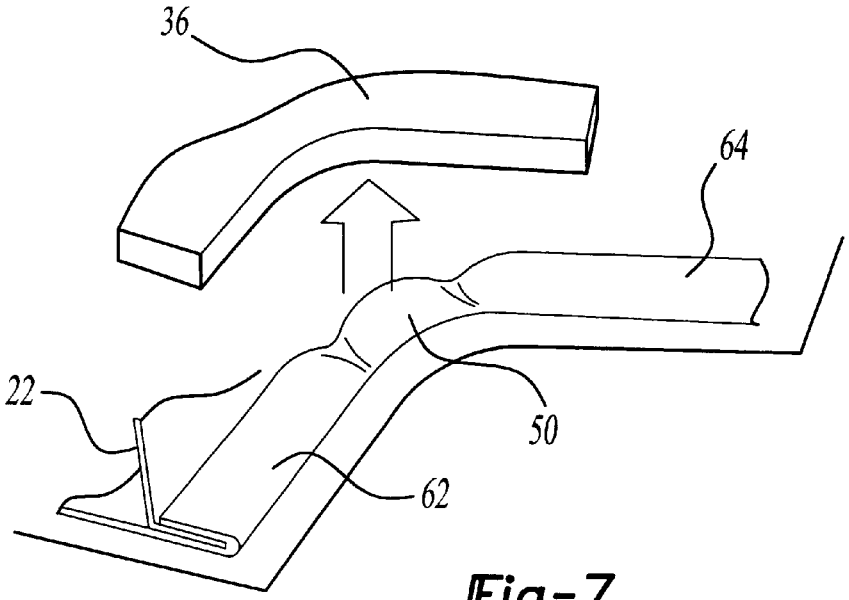
FIG. 7 is a fragmentary perspective view illustrating one corner die set.

An exemplary corner die 36 is shown in FIG. 7 in which a corner 60 between two adjacent sides 62 and 64 of the hem is illustrated just prior to the corner hem operation. Following the final hem operation on the sections 62 and 64 of the workpiece 22, the corner section 60 is bent slightly from its original unhemmed position due to the hemming operations formed on the straight sections 62 and 64. However, unlike the straight sections 62 and 64, the corner 60 is not retrorsely formed on the part 22 following the final hem with the die set 34. However, since the die set 36 flattens only the corner sections 60, a completed hem is formed around the entire part.

From the foregoing, it can be seen that the present invention provides a simple and yet highly effective inside hemming machine. Having described my invention, however, many modifications thereto will become apparent to those skilled in the art to which it pertains without deviation from the spirit of the invention as defined by the scope of the appended claims.

We claim:

1. An inside hemming machine comprising:

a base adapted to be supported by a ground surface, a nest vertically movably mounted to said base, said nest having a central through opening and adapted to support a part to be hemmed, at least one actuator for vertically moving said nest relative to said base between predetermined vertical positions, a die assembly housing mounted to said base, said die assembly housing extending through said nest opening, at least two die sets, means for horizontally sidably mounting said die sets to said housing so that said die sets are movable between an extended aid a retracted position, one of said die sets being vertically spaced from the other die set, means for selectively moving said die sets between said extended and said retracted position wherein said moving means comprises a plurality of wedge drive members each vertically slidably mounted in said housing and each movable between a first position and a second position, said drive members each having a drive surface lying in a plane which is skewed with respect to the direction of movement of said nest, a plurality of driven members in which one driven member is associated with one drive member, each driven member having a skewed surface which flatly abuts against said skewed surface of its associated drive member, means for horizontally slidably mounting said driven members to said housing while preventing vertical movement of said driven members, said die sets being secured to said driven members and wherein said moving means further comprises a dovetail connection between each of said drive surface of each said drive member and each said skewed surface of its associated driven member whereby said dovetail connections operate to both extend and retract said die sets relative to said housing.

2. The invention as defined in claim 1 wherein at least two drive members are vertically spaced from each other.

3. The invention as defined in claim 2 wherein at least three drive members are each vertically spaced from each other.

4. The invention as defined in claim 1 wherein said drive members with their associated driven members are positioned in said housing in a first, second and third vertically spaced levels, said die sets attached to said driven members in said first level forming a prehem, said die sets attached to said driven members in said second level forming a final hem, and said die sets attached to said driven members in said third level forming a final corner hem.

5. The invention as defined in claim 1 wherein said means for moving said die sets between said extended and said retracted positions comprises a shaft sliding on two bushings mounted on said housing and rigidly connected to each drive member, and a linear actuator to axially move said shaft.

6. The invention as defined in claim 5 wherein said linear actuator comprises a pneumatic cylinder.

7. The invention as defined in claim 5 wherein said linear actuator comprises a hydraulic cylinder.

8. The invention as defined in claim 5 wherein said linear actuator comprises an electric servo motor.

* * * * *